US008197672B2

(12) United States Patent
Romero et al.

(10) Patent No.: US 8,197,672 B2
(45) Date of Patent: Jun. 12, 2012

(54) HYDROPROCESSING OF NAPHTHA STREAMS AT MODERATE CONDITIONS

(75) Inventors: Yilda Romero, Aragua (VE); Jorge Tejada, Edo. Miranda (VE); Jose de la Cruz Castro, Edo. Miranda (VE); Rosa Caldera, Edo. Miranda (VE)

(73) Assignee: Intevep, S.A., Caracas (VE)

( * ) Notice: Subject to any disclaimer, the term of this patent is extended or adjusted under 35 U.S.C. 154(b) by 658 days.

(21) Appl. No.: 12/193,101

(22) Filed: Aug. 18, 2008

(65) Prior Publication Data

US 2009/0008294 A1 Jan. 8, 2009

Related U.S. Application Data

(62) Division of application No. 11/090,752, filed on Mar. 24, 2005.

(51) Int. Cl.
*C10G 45/08* (2006.01)
*C10G 45/10* (2006.01)

(52) U.S. Cl. ..... 208/216 R; 208/217

(58) Field of Classification Search ..... 208/208 R, 208/209, 213, 216 R, 217
See application file for complete search history.

(56) References Cited

U.S. PATENT DOCUMENTS

| | | | | |
|---|---|---|---|---|
| 3,808,153 | A * | 4/1974 | Shomitz et al. | 502/355 |
| 4,295,995 | A | 10/1981 | Bearden, Jr. et al. | |
| 4,791,090 | A | 12/1988 | Pereira et al. | |
| 5,137,859 | A | 8/1992 | Fujikawa et al. | |
| 5,423,976 | A * | 6/1995 | Sudhakar et al. | 208/216 R |
| 5,770,046 | A * | 6/1998 | Sudhakar | 208/216 R |
| 6,383,974 | B1 | 5/2002 | Ishida et al. | |
| 7,557,062 | B2 | 7/2009 | Domokos et al. | |
| 2003/0111390 | A1 | 6/2003 | Tejada et al. | |
| 2003/0168380 | A1 | 9/2003 | Didillon et al. | |
| 2003/0205505 | A1 | 11/2003 | Tejada et al. | |
| 2006/0213814 | A1 | 9/2006 | Romero et al. | |

FOREIGN PATENT DOCUMENTS

| | | |
|---|---|---|
| JP | 08277395 | 10/1996 |

OTHER PUBLICATIONS

R. Thomas et al., Characterization of γ-Alumina-Supported Molybdenum Oxide and Tungsten Oxide—Reducibility of the Oxidic State versus Hydrodesulfurization Activity of the Sulfided State, 76 J. Catal. 241-253 (1982).*

T. Klimova et al., New Selective Mo and NiMo HDS Catalysts Supported on Al2O3-MgO(x) Mixed Oxides, 43 Catal. Today 135-146 (1998).*

Jones et al. Temperature-Programmed Reduction for Solid Materials Characterization, CRC Press (1986) pp. 1-9.

Reiche et al. Characterization by temperature programmed reduction. Catalysis Today 50, 347-355 (2000).

* cited by examiner

*Primary Examiner* — Jill Warden
*Assistant Examiner* — Randy Boyer
(74) *Attorney, Agent, or Firm* — Bachman & LaPointe, P.C.

(57) ABSTRACT

The invention is drawn to a catalyst having a substantially bimodal support phase and an active metal phase that is suitable and stable for desulfurization of high-olefin content naphtha streams with minimal octane-loss running at low hydrogen pressure. The active metal phase preferably includes cobalt, molybdenum and at least one additional metal selected from the alkali-metals group.

14 Claims, 1 Drawing Sheet

HYDROPROCESSING OF NAPHTHA STREAMS AT MODERATE CONDITIONS

CROSS REFERENCE TO RELATED APPLICATIONS

This application is the U.S. divisional application of U.S. application Ser. No. 11/090,752 filed Mar. 24, 2005.

BACKGROUND OF THE INVENTION

The naphtha from catalytic cracking typically contains substantial amounts of both sulfur and olefins and is a major contributor to sulfur in the gasoline pool. Due to environmentally driven regulatory pressures, the demand for lower sulfur gasoline is increasing. This implies that increasing severity in hydrotreating processes to reduce sulfur (HDS) in olefinic cracked naphthas is required. Deep HDS of these naphthas requires improved technology to avoid olefin saturation that results in high-octane loss across the process. The invention relates to a hydroprocessing catalyst, a method for preparing a hydroprocessing catalyst and a process for using same to provide reduced sulfur gasoline and gasoline additives with maintained octane levels.

The naphtha hydrodesulfurization process usually runs at high temperature, and a pressure over 400 psig, and the catalyst used typically involves non-noble metal sulfided species supported over an inorganic refractory material. The most commonly used metallic phases are CoMoS and NiMoS. A conventional hydrodesulfurization catalyst has both hydrogenation and desulfurization activities. When naphthas with high olefin content are desulfurized, it is desirable to minimize hydrogenation even with the fresh catalyst to reduce olefin saturation and the resulting octane-loss. Further, the octane loss increases with the severity of the desulfurization conditions.

Olefinic cracked naphthas (and coker naphthas as well) typically contain more than 20 wt % olefin. During a conventional hydrodesulfurization process (HDS) at least a portion of the olefins are hydrogenated, and this reaction increases for higher sulfur reduction in the feedstock. Since olefins are a high octane number species, it is desirable to retain them as much as possible. In conventional HDS processing for cracked naphtha, additional refining processes, such as isomerization, sweetening and blending, are required to produce high-octane fuels. Such additional processing adds significantly to the costs of production.

It is the primary object of the present invention to provide a suitable catalyst and a process for using same. The catalyst is selective to desulfurization of cracked naphtha with high olefin content while minimizing octane-loss with a demonstrable stability running at low hydrogen pressures.

Other objects and advantages of the present invention will appear herein below.

SUMMARY OF THE INVENTION

The invention relates to a sulfur removal selective catalyst and a process for preparing same. The catalyst is suitable for desulfurizing cracked naphtha that contains both olefin and sulfur.

The catalyst described in this invention provides selective hydrodesulfurization of cracked naphtha with a minimal olefin hydrogenation activity.

According to the invention, a catalyst and process for preparing same are provided wherein the catalyst has a substantially bimodal support and contains a combination of functional metals which provide desired selectivity to hydrodesulfurization.

According to the invention, a catalyst is provided for hydrodesulfurization of olefinic naphtha, comprising a porous support; and a catalytic phase on the support comprising a Group VI element, a Group VIII element and at least one element from Groups I and II of the periodic table of elements (CAS version); wherein the catalyst is present in species having reducibility characterized by two distinct signals, as measured by Temperature Programmed Reduction (TPR), one of which is less than or equal to about 1000 K and another of which is greater than about 1000 K.

According to the invention, the support is preferably a porous bimodal structure, that is, the support has two distinct groupings of pore sizes among the pore size distribution of the support.

Preferably, the bimodal support includes a first band of up to about 60% vol. of the pores in the support have a pore size of between about 20 and about 60 angstroms. No more than about 20% vol. of the pores have a pore size greater than about 150 angstroms.

The catalyst is advantageously prepared to include a combination of metals selected from groups VI, VIII, I and II (CAS version) of the periodic table of elements. Most preferably, this combination of metals includes cobalt, molybdenum and alkali metals. A particularly preferred combination of metals for the catalyst provided in this invention comprises cobalt, molybdenum and calcium.

A method is also provided for selective hydrodesulfurization of an olefinic naphtha feed comprising, providing a naphtha feed containing sulfur and olefins; exposing the feed under hydrodesulfurization conditions to a catalyst comprising a porous support and a catalytic phase on the support comprising a Group VI element, a Group VIII element and at least one element from Groups I and II of the periodic table of elements (CAS version), wherein the catalyst is present in species having reducibility characterized by two distinct signals, as measured by Temperature Programmed Reduction (TPR), one of which is less than or equal to about 1000 K and another of which is greater than about 1000 K so as to remove sulfur from the feed while substantially preserving the olefins.

The reaction conditions for hydrodesulfurization of the naphtha streams with high olefin content include temperatures between about 460° F. and about 680° F., pressures of between about 60 and 500 psig, hydrogen treat gas rates of between about 1000 and 3000 standard cubic feet per barrel, and liquid space velocity of between about 1 and about 8 $h^{-1}$.

BRIEF DESCRIPTION OF THE DRAWINGS

A detailed description of preferred embodiments of the present invention follows, with reference to the attached drawings, wherein.

DETAILED DESCRIPTION

Figure 1:
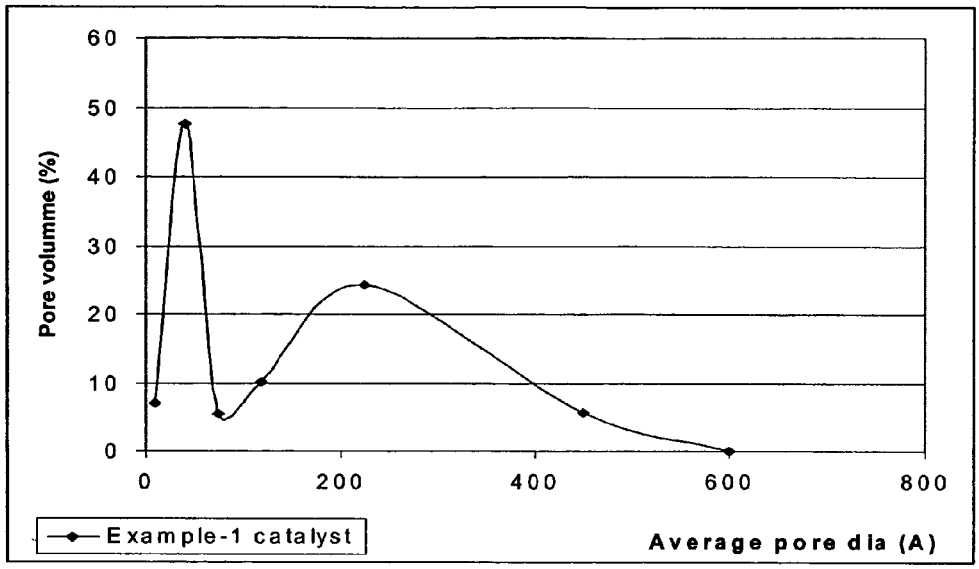
FIG. 1 shows the pore distribution of a catalyst in accordance with the present invention.

As set forth above, the invention relates to a hydrosulfurization catalyst for processing of high-olefin content naphtha streams. The catalyst preferably has a bimodal or bi-functional catalyst support and a combination of active metals or elements. Advantageously, the catalyst in accordance with the present invention shows excellent selectivity towards the desired reactions, especially toward hydrodesulfurization while avoiding olefin hydrogenation.

The catalyst is characterized by properties discussed below, including combination of metals, metal dispersion and reducibility of metal species as well as other properties which advantageously provide the catalyst under process conditions with excellent HDS activity and very little HDO activity as desired.

The catalyst comprises a catalyst support and a catalytic phase, and the support is preferably an aluminum oxide designed as a bimodal support. The catalytic phase preferably includes a combination of a Group VIII metal, a Group VI metal and a Group I and/or II element of the periodic table of elements (CAS version). The catalyst can be prepared by mixing sources of the desired support and active metals, for example, by mixing powdered aluminum hydroxide, cobalt nitrate, ammonium heptamolybdate and calcium nitrate.

The aluminum oxide support can advantageously be a powdered aluminum hydroxide. This powdered aluminum hydroxide advantageously has a surface area of about 300 $m^2/g$, an average pore diameter of about 44 angstroms, a pore volume of about 0.45 $m^3/g$, and has about 60% of the pore volume in pores having a pore size between about 20 and about 60 angstroms. The material further preferably has no more than about 20% of the pore volume in pores greater than about 150 angstroms in size. The particle size of this starting material is preferably between about 1 and about 20 μm, more preferably between about 3 and about 10 μm.

The active metals are advantageously selected from the group consisting of metals of Groups VI, VIII, I and II of the periodic table of elements (CAS version), and combinations thereof. More preferably, the metals include a Group VI metal, a Group VIII metal and a Group I and/or II metal, and a particularly preferred combination of metals comprises cobalt, molybdenum and calcium or magnesium, preferably calcium.

These metals can be mixed in their salt form or in any other suitable source material.

After mixing sufficiently to provide a substantially homogeneous mixture, a binder solution, for example, acetic acid, is added as a binder. The resulting mixture is powdered into an extrusion machine which extrudes the mixture into cylindrical form, for example, having a diameter of approximately 1/16 inch or other sizes as may be dictated by the end use. The binder solution could be selected from aqueous acid solution between 1-15% v/v, prepared for example using mineral or organic acid, and a 2.5% v/v acetic acid solution is preferred.

After a suitable drying period, the catalyst is calcined, preferably in a series of steps, and the result is a catalyst having a bimodal pore distribution support and an active metal phase disposed thereon as desired.

The drying step may be carried out in air, for example at a temperature of about 248° F., for a period of several hours.

The calcination is preferably carried out in a plurality of steps, each starting with a controlled rate increase in temperature followed by a holding period at that temperature. Broad and preferred ranges for temperatures, temperature increase rate and holding times are set forth in Table 1.

TABLE 1

Catalyst Calcination Conditions

| | Broad Range | | | Preferred Range | | |
|---|---|---|---|---|---|---|
| Step | Temperature (° F.) | Ascending Temp rate (° F./min) | time (h) | Tem-perature (° F.) | Ascending Temp rate (° F./min) | time (h) |
| 1 | 140-260 | 15-60 | 0.5-6 | 248 | 30 | 2 |
| 2 | 392-530 | 15-60 | 0.5-6 | 464 | 30 | 2 |
| 3 | 788-864 | 15-60 | 0.5-10 | 842 | 30 | 8 |

The resulting catalyst is characterized by metal species on the surface of the catalyst with reducibility characterized by a plurality of distinct signals, preferably with at least one at a TPR measured temperature of less than about 1000 K and with one at a TPR measured temperature of greater than about 1000 K. The area of these signals present ratios with respect to each other as indicated in Table 2 below:

TABLE 2

| Signal | Broad Area Ratio | Preferred Area Ratio |
|---|---|---|
| (1 + 2)/3 | 0.1-0.8 | 0.15-0.5 |
| 1/3 | 0.1-0.8 | 0.15-0.5 |
| 2/3 | 0.05-0.5 | 0.05-0.2 |

The actual temperature location of these signals, measured by TPR, is as set forth in Table 3 below:

TABLE 3

| Signal | Broad Temp (K) | Preferred Temp (K) |
|---|---|---|
| 1 | 574-724 | 590-690 |
| 2 | 750-1014 | 850-950 |
| 3 | >1014 | 1014-1200 |

FIG. 1 shows a pore size distribution for a catalyst according to the invention. As shown, the catalyst has a first band of pore sizes which in this instance falls in a range between about 20 and about 60 angstroms, and a second band substantially larger in size, in this example between about 150 and about 350 angstroms, with a maximum concentration in this band at about 225 angstroms.

Figure 2:
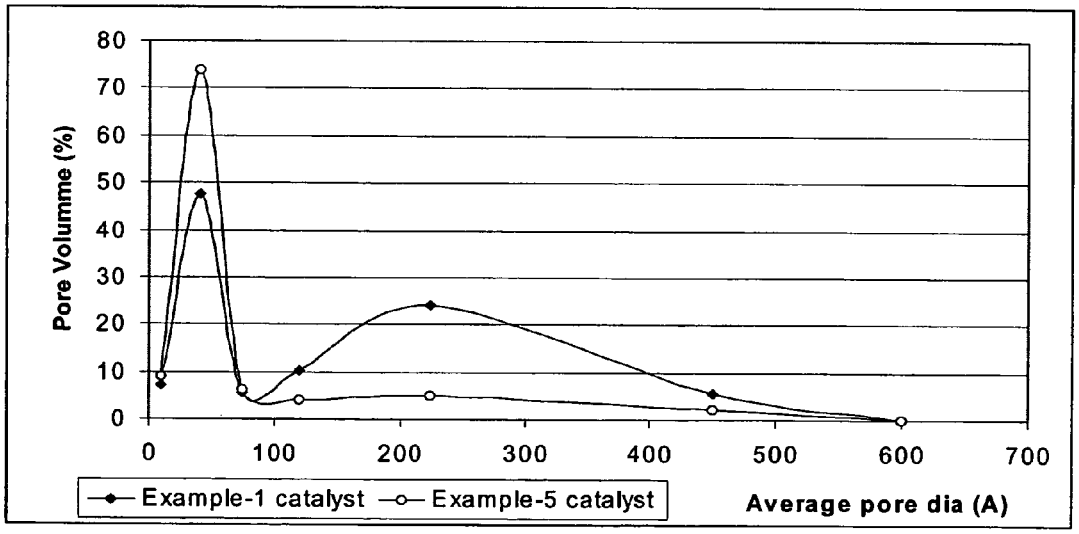
FIG. 2 further illustrates pore distribution for a monomodal catalyst for comparison.

FIG. 2 shows pore distributions for monomodal (Example 5 below) and bimodal (Example 1 below) catalysts, and the difference in pore distribution is evident. While both supports provide good results, the bimodal supported catalyst is preferred.

The catalyst advantageously has relatively higher concentrations of the active metals at the surface of the catalyst than within the catalyst bodies. For example, the catalyst may preferably have a surface concentration of CoO of between about 2.0 and about $6.0\times10^{-3}$ $g/m^2$, and a surface concentration of $MoO_3$ of between about 2.0 and about $3.0\times10^{-2}$ $g/m^2$.

The catalyst advantageously has a median pore diameter of between about 300 and about 500 angstroms. The catalyst further preferably has no Bronsted acidity at 200° C. and a Lewis acidity between about 180 and about 200 mol of pyridine adsorbed per gram.

As set forth above, the catalyst of the invention is also characterized by a reducibility of metal species on the surface showing at least two and preferably three distinct signals. When two signals are present, these signals preferably include one which is less than about 1024 K. When three signals are present, then two are preferably less than about 1024 K. These measurements are taken under temperature programmed reduction (TPR). A ratio of the area of the low signal (<1000 K) to the area of the high signal (>1000 K) is preferably at least about 0.2. This ratio is taken for catalysts with two signals as the low signal area to the high signal area, and for catalysts with three signals as the two low signal areas to the high signal area.

The catalyst as set forth above preferably has a bimodal pore structure in the support, with broad and preferred average pore sizes and concentrations as shown in Table 4 below.

TABLE 4

| | | Broand Range | | Preferred Range | |
|---|---|---|---|---|---|
| | Band | Pore size (A) | Amount of pores (%) | Pore size (A) | Amount of pores (%) |
| Bi-modal catalyst | 1 | 20-60 | 20-60 | 55 | 30 |
| | 2 | 90-300 | 20-40 | 150 | 25 |

Broad and preferred metal types and contents are also set forth herein in Table 5 below.

TABLE 5

| | Broand Range | | Preferred Range | |
|---|---|---|---|---|
| Metals | Type | Content of metal (wt %) | Metal | Content of metal (wt %) |
| 1 | VIII | 0.5-5 | Co | 1 |
| 2 | VI | 2-10 | Mo | 4 |
| 3 | I-II | 0.01-2 | Ca, Mg | 0.5 |
| | Co/(Co + Mo) | 0.28-0.45 | Co/(Co + Mo) | 0.3 |

The catalyst of the present invention is well suited for use in treating olefin-containing naphtha feedstocks for removal of sulfur. The catalyst advantageously does not enhance hydrogenation of olefins, and is substantially selective to sulfur removal reactions as desired.

The following examples further illustrate preparation of catalyst in accordance with the present invention, as well as characteristics thereof.

Example 1

A catalyst was provided containing approximately 80 wt % aluminum oxide, which as a starting material had an average pore diameter as measured by nitrogen of 44 angstroms, a surface area of about 300 $m^2/g$, a pore volume of about 0.45 $cm^3/g$, 60% vol. of the pores located between 20-60 angstroms and no more than 20% vol. of the pores greater than 150 angstroms in diameter. This is a bimodal support.

The catalyst was prepared mixing 116 g of powder aluminum hydroxide with 6.70 g of cobalt nitrate, 8.85 g of ammonium heptamolybdate and 3.63 g of calcium nitrate, which was included as additive. After enough mixing to provide a substantially homogeneous mixture, a 2.5% acetic acid binder solution in an adequate amount is added, the resulting mixture was powdered into an extrusion machine to provide extrudates in cylindrical form with an average diameter of 1/16 inch. These particles were dried overnight in air at 248° F. Calcination was performed in three steps, starting at room temperature and increasing to 248° F. at a rate of 30° F./min. The particles were held at that temperature for 2 hours. In the second step: continuous increase in temperature to 464° F. in air, at the same rate, was performed. The particles were held at this temperature for 2 hours. And for the last step, the temperature was increased to 842° F. in air, and held at that temperature for four hours.

The resulting catalyst is Catalyst A, which is used in Example 4 below. Catalyst A has 360 $m^2/g$ surface area, a pore volume of about 0.41 $cm^3/g$, an average pore diameter as measured by nitrogen of 55 angstroms, with 30% vol. of the pores located between 20-60 angstroms, and 6.4 wt % of total metal-promoter loading with a Co/(Co+Mo) ratio of 0.31.

Example 2

A catalyst containing cesium as an additive instead of calcium was prepared by using the same support described above. 150 g of the described powder aluminum hydroxide were mixed with 8.66 g of cobalt nitrate, 11.45 g of ammonium heptamolybdate and 2.34 g of cesium nitrate. After sufficient mixing, the mixture was extruded, dried and calcined as described in Example 1. The result is Catalyst B, which is used in Example 4 below. This catalyst has a surface area of 320 $m^2/g$, a pore volume of about 0.41 $cm^3/g$, an average pore diameter as measured by nitrogen of 58 angstroms, with 32% vol. of the pores located between 20-60 angstroms, and 6.4 wt % of total metal-promoter loading with a Co/(Co+Mo) ratio of 0.31.

Example 3

A catalyst was prepared by mixing 150 g of a powder aluminum hydroxide (bimodal support) with 10.70 g of cobalt nitrate, 14.4 g of ammonium heptamolybdate and 4.73 g of calcium nitrate, which was included as additive. After sufficient mixing conditions were achieved, the mixture was extruded, dried and calcined as described in Example 1. The resulting catalyst is Catalyst C, which is used in Example 4 below. Catalyst C has a surface area of 320 $m^2/g$, a pore volume of about 0.36 $cm^3/g$, an average pore diameter as measured by nitrogen of 49 angstroms, with 35% of the pores located between 20-60 angstroms, and with 7.1 wt % of total metal-promoter loading with a Co/(Co+Mo) ratio of 0.31.

Example 4

Isothermal, downflow, all-vapor phase runs were made using a small fixed-bed unit (bench scale), with 30 cc of catalyst and a depentanized catalytic naphtha as feedstock. The naphtha had a 148-427° F. boiling range (5% and 95% distillation boiling points—ASTM-2887), 372 wppm total sulfur, and 35 bromine number. The total sulfur content was determined by using UV-spectroscopy (ASTM-5453). The olefin saturation in this and all examples herein was determined by using the PIONA test (method developed by PDVSA-INTEVEP-AI-0258-99 adapted from ASTM 6623).

The CoO surface concentrations determined by XPS (X-ray photoelectron spectroscopy) for these catalysts were between 2.0 and $6.0\times10^{-3}$ g $CoO/m^2$, and the $MoO_3$ surface concentrations were between 2.0 and $3.0\times10^{-2}$ g $MoO_3/m^2$. The average particle diameters were 1/16 inch, and the median pore diameters were 300-500 angstroms as measured by mercury intrusion on the fresh catalysts in oxidized form. The acidity of these catalysts determined by pyridine adsorption followed by desorption at different temperatures showed that the catalyst of this invention has no Bronsted acidity at 200° C., and Lewis acidity between 180-200 mol of pyridine adsorbed per gram of sample.

The reducibility of metal species on surface, measured by Temperature Programmed Reduction (TPR), showed that the catalyst described in this invention has two distinct signals at less than 1000 K and greater than 1000 K, and the ratio of the area of the first signal/second signal is at least 0.2.

Each catalyst was sulfided in situ with a 2% wt. S from DMDS diluted in heavy virgin naphtha blend at 540° F. for 8 hours. For the tests, the reactor conditions were 534° F., $H_2$/feed ratio of 1500 scf per bbl, 100% hydrogen treat gas, 200 psig total inlet pressure and space velocity equal to 4 $h^{-1}$. Table 6 below lists the selectivity for the different catalysts as compared to a commercial catalyst. The selectivity factor has been calculated as a ratio of (hydrodesulfurization/olefin hydrogenation).

TABLE 6

| Catalyst | Co + Mo wt % | Area ($m^2$/gr) | Major Pore Diameter (A)[a] | Selectivity (HDS/HDO) |
|---|---|---|---|---|
| A | 5.0 | 360 | 20-60 (30%) | 6.99 |
| B | 5.0 | 320 | 20-60 (32%) | 5.86 |
| C | 6.1 | 320 | 20-60 (35%) | 4.25 |
| Commercial | 5.0 | 356 | 20-60 (51%). | 3.39 |

[a]the number in parenthesis represents the proportion of pores in that pore diameter range According to Table 6, Catalyst A of this invention shows a high selectivity towards the HDS reaction while minimizing olefin saturation. Reduction in selectivity was found with the use of Cs instead of Ca and for increasing total metal content. All the catalyst prepared using the methodology described in this invention showed higher selectivity than the commercial catalyst.

Example 5

A catalyst was provided containing no additive with approximately 80 wt % of aluminum oxide, which as a starting material had an average pore diameter as measured by nitrogen of 44 angstroms, a surface area of about 370 $m^2$/g, a pore volume of about 0.32 $cm^3$/g, and with 67% of the pores located between 20-60 angstroms and no more than 13% of the pores greater than 150 angstroms in diameter (monomodal support).

The catalyst was prepared mixing 150 g of powder aluminum hydroxide with 8.60 g of cobalt nitrate, 11.4 g of ammonium heptamolybdate. A mixing process was applied to the mixture. After enough mixing this mixture was extruded, dried and calcined as described in Example 1. The resulting catalyst, designated as Catalyst D, which is used in Example 7 below, has a surface area of 390 $m^2$/g, a pore volume of about 0.29 $cm^3$/g, an average pore diameter as measured by nitrogen of 34 angstroms, with 65% of the pores located between 20-60 angstroms, and 6.4 wt % of total metal-promoter loading with a ratio Co/(Co+Mo) of 0.31.

Example 6

A catalyst was prepared mixing 150 g of powder aluminum hydroxide (monomodal support, described in Example 5) with 8.60 g of cobalt nitrate, 11.4 g of ammonium heptamolybdate and 4.66 g of calcium nitrate. After sufficient mixing, the mixture was extruded, dried and calcined as described Example 1. The resulting catalyst is Catalyst E, which is used in Example 7 below. Catalyst E has a surface area of 390 $m^2$/g, a pore volume of about 0.28 $cm^3$/g, an average pore diameter as measured by nitrogen of 33 angstroms, with 65% of the pores located between 20-60 angstroms, and 6.4 wt % of total metal-promoter loading with a ratio Co/(Co+Mo) of 0.31. The CoO surface concentrations determined by XPS (X-ray photoelectron spectroscopy) for the catalysts were between 3.0 and $6.5\times10^{-3}$ g CoO/$m^2$, and the $MoO_3$ surface concentrations were between 3.0 and $4.0\times10^{-2}$ g $MoO_3$/$m^2$ for catalyst containing the alkali metal. Similar measurements were obtained for a mechanical mixture of CoO+MoO3+commercial $Al_2O_3$ disperal SB-30 (from CONDEA), prepared with the same metal content as Example 5. The dispersion values found for these mechanical mixture catalysts were 2.0-3.0× $10^{-3}$ g CoO/$m^2$ and 1.8-2.2×$10^{-2}$ g $MoO_3$/$m^2$. This shows that using alkali metal as an additive increases the metal-exposure at the surface. The average particle diameters were 1/16 inch, and the median pore diameter was between 100-200 angstroms as measured by mercury intrusion on fresh catalyst in oxidized form. The reducibility of metal species on surface, measured by Temperature Programmed Reduction (TPR), showed that the catalyst described in this invention has three distinct signals, two at less than 1000 K and one at greater than 1000 K, and the ratio of the area of the (first+second) signal/third signal is greater than about 0.9.

Comparing with a catalyst prepared with the same metal content as described in Example 5, using a commercial alumina dispersal (SB-30), the TPR pattern shows two signals both greater than 1000 K, and the ratio between these two signals was 0.19.

A catalyst prepared with the same procedure described in Example 1, using alumina dispersal SB-30, a catalyst was prepared for comparison purpose. This catalyst shows three signals in the TPR pattern, two at less than 1000 K and one at greater than 1000 K, and the ratio between the two first signals over the third one was 0.35. This implies that both the support used in this invention, as well as the metal formulation, determine the metal-support interaction, and in consequence the reducibility of the metal species. This could be due to a specific metal species on the surface that is promoted by both metal formulation and the support used in this invention.

Acidity of the catalysts in their oxidized form was determined by pyridine adsorption followed by desorption at different temperatures. The catalyst of this invention has no Bronsted acidity at 392° F. (200° C.) and the amount of Lewis sites was between 180-200 mol/gr sample of pyridine adsorbed per gram of sample (molPy/gr sample). Furthermore, the catalyst prepared using CoMo, with no additive, supported on SBA-30, shows a small amount of Bronsted sites at 392° F. (4.41 molPy/grample) and similar Lewis acidity to the catalyst of this invention. This indicates that the metal formulation described in this invention generates a homogenous material with a unique type of acid site, providing more specificity in the kind of catalyst reaction that can be accomplished.

Example 7

Isothermal, downflow, all-vapor phase runs were made using a bench scale unit with a depentanized catalytic naphtha feedstock. The naphtha was found to have a 148-427° F. boiling range (5% and 95% distillation boiling points—ASTM-2887), 372 wppm total sulfur, and 35 bromine number. Each catalyst was sulfided in situ with a 2% wt. S from DMDS diluted in heavy virgin naphtha blend at 540° F. for 8 hours. For the tests, the reactor conditions were 534° F., $H_2$/feed ratio of 1500 scf per bbl, 100% hydrogen treat gas, 200 psig total inlet pressure and space velocity of 4 $h^{-1}$. Table 7 below lists the selectivity for catalysts A, D and E compared with a commercial one. The selectivity factor has been calculated as the ratio (hydrodesulfurization/olefin hydrogenation).

TABLE 7

| Catalyst | Co + Mo wt % | Area ($m^2$/gr) | Major Pore Diameter (A)[a] | Selectivity (HDS/HDO) |
|---|---|---|---|---|
| A | 5.0 | 360 | 20-60 (30%) | 6.99 |
| D | 5.0 | 390 | 20-60 (65%) | 4.20 |
| E | 5.0 | 390 | 20-60 (65%) | 4.30 |
| Commercial | 5.0 | 356 | 20-60 (51%) | 3.39 |

[a]the number in parenthesis is the proportion of pores in that pore diameter range.

Catalyst A, with bimodal support, showed better selectivity than prototypes supported on monomodal support, although even the monomodal support was more selective than commercial catalyst. With a monomodal support the additive seems to have no influence on catalyst selectivity. Following the physicochemical properties of the catalysts described in Example 6, it seems that both surface metal dispersion and type of superficial metal species are responsible for the selectivity of the catalyst, as was observed at bench scale, with bimodal pore structure of the catalyst having an extra benefit.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A method for selective hydrodesulfurization of an olefinic naphtha feed, comprising:

providing a naphtha feed containing sulfur and olefins;

exposing the feed under hydrodesulfurization conditions to a catalyst comprising a porous support and a catalytic phase material on the support comprising a Group VI element, a Group VIII element and at least one element from Groups I and II of the periodic table of elements (CAS version), wherein the catalyst is present in species having reducibility characterized by at least two distinct signals, as measured by Temperature Programmed Reduction (TPR), one of which is less than or equal to about 1000K and another of which is greater than about 1000K so as to remove sulfur from the feed while substantially preserving the olefins, wherein the catalyst has a higher concentration of the catalytic phase material at a surface of the catalyst than within the catalyst.

2. The method of claim 1, wherein a ratio of HDS activity to HDO activity is at least about 4.25.

3. The method of claim 1, wherein the catalytic phase material is produced by the steps of:

mixing the Group VI element, the Group VIII element and at least one element from Groups I and II;

adding a binder solution to the mixed Group VI element, Group VIII element and at least one element from Groups I and II;

extruding the mixed binder solution, Group VI element, Group VIII element and at least one element from Groups I and II to produce a wet catalyst phase material;

drying the wet catalyst phase material to produce a dry catalyst phase material; and calcinating the dry catalyst phase material to produce the catalyst phase material.

4. The method of claim 3, wherein the binder solution is selected from the group consisting of acetic acid, mineral acid, organic acid and mixtures thereof.

5. The method of claim 3, wherein the binder solution is present in the amount of 1% v/v to 15% v/v.

6. The method of claim 3, wherein the extruding step extrudes the catalyst into cylinders.

7. The method of claim 6, wherein the cylinders have a diameter of about 1/16 inch.

8. The method of claim 3, wherein the drying step is carried out in air at a temperature of about 248° F. for a period of several hours.

9. The method of claim 3, wherein the calcinating step takes place in a plurality of steps.

10. The method of claim 9, wherein the plurality of steps is a controlled rate increase in temperature wherein step one is from 140° F. to about 260° F. for 0.5 hours (h) to about 6 h, step two is from 392° F. to about 530° F. for 0.5 h to about 6 h, and step three is from 788° F. to about 864° F. for 0.5 h to about 10 h.

11. The method of claim 10, wherein the controlled rate is an ascending temperature rate of 15° F./min to about 60° F./min.

12. The method of claim 1, wherein the Group VIII element is cobalt, wherein the Group VI element is molybdenum and wherein the catalyst has a surface concentration of cobalt oxide of between about 2.0 and about $6.0\times10^{-3}$ g/$m^2$, and a surface concentration of molybdenum oxide ($MoO_3$) of between about 2.0 and about $3.0\times10^{-2}$ g/$m^2$.

13. The method of claim 1, wherein the porous support consists essentially of alumina, and wherein the catalytic phase material is supported on the support.

14. The method of claim 1, wherein the exposing step is carried out at a temperature of between about 460° F. and about 680° F., a pressure of between about 60 and about 500 psig, a hydrogen treat gas rate of between about 1000 and 3000 standard cubic feet per barrel, and a liquid space velocity of between about 1 and about $8_h^{-1}$.

* * * * *